United States Patent [19]

Hyde

[11] Patent Number: 4,826,427

[45] Date of Patent: May 2, 1989

[54] PILOT BURNER WITH DRAIN

[76] Inventor: King W. Hyde, 1414 N. Belmont, Odessa, Tex. 79761

[21] Appl. No.: 195,602

[22] Filed: May 18, 1988

Related U.S. Application Data

[63] Continuation-in-part of Ser. No. 550,748, Nov. 10, 1983, abandoned.

[51] Int. Cl.[4] ..... F23D 13/20

[52] U.S. Cl. ..... 431/202; 431/264

[58] Field of Search ..... 431/192, 202, 4, 264, 431/278, 286, 350, 353, 354; 60/737, 749; 239/428.5; 313/118

[56] References Cited

U.S. PATENT DOCUMENTS

| | | | |
|---|---|---|---|
| 2,480,230 | 8/1949 | Elster | 431/202 X |
| 2,661,798 | 12/1953 | Clevenger et al. | 431/202 X |
| 3,729,287 | 4/1973 | Strashok | 431/202 X |
| 3,986,817 | 10/1976 | Lambiris | 431/264 |
| 4,248,585 | 2/1981 | Marcyniuk | 431/202 |
| 4,406,615 | 9/1983 | Guerra et al. | 431/202 X |
| 4,433,266 | 2/1984 | Riehl | 431/264 |
| 4,610,622 | 9/1986 | Quinnel | 431/202 X |

*Primary Examiner*—Randall L. Green

*Attorney, Agent, or Firm*—Wendell Coffee

[57] ABSTRACT

A pilot burner has a saddle whereby it is attached to a flare pipe. The top of the pilot burner is at the flame end of the flare pipe so that a torch or flame from the pilot burner will ignite any waste gas being flared. The pilot burner is of tubular construction and includes a combustion chamber. The combustion chamber has a drain in the lower portion so that any fluids within the tubular pilot burner may be drained from it without impeding the flow of gas/air mixture entering the combustion chamber. A spark from a plug in the combustion chamber ignites the pilot flame. The electrical connector to the spark plug is in the form of ¼" diameter stainless steal rod which is supported by ceramic insulators to avoid the electrical system being damaged by fire.

4 Claims, 1 Drawing Sheet

PILOT BURNER WITH DRAIN

CROSS REFERENCE TO RELATED APPLICATION

This application is a continuation-in-part of my prior patent application; Ser. No. 06/550,748; entitled FLARE IGNITION; which was filed on Nov. 10, 1983, now abandoned.

BACKGROUND OF THE INVENTION (1) Field of the Invention

This invention relates to burning waste gas, and more particularly to ignitors for igniting the flare.

(2) Description of the Related Art

It has long been customary around the production of petroleum products and the refining of them to burn or to flare waste gases. These waste gases may occur because of their noxious properties or because of a production or processing emergency.

In an emergency situation it is desirable that the operating personnel not have the responsibility of igniting the flare and once the gases are put to the flare that they will be ignited with certainty. Therefore, the reliability of the ignitor is one of its most important attributes.

Originally the flare pipes were vertical and often referred to as stacks. However, many of the flare pipes are horizontal, which introduces additional problems. The problem with many flare ignitors is the wind blowing them out. Of course the wind normally moves horizontally; therefore, with the vertical stack, all that was necessary was to protect the ignitor. However, with a horizontal flare, the wind may be blowing down the flare pipe. The difficulty is that the flame is blown back upon the ignitor parts and will often destroy them. The fire problem is paticularly pointed out in the U.S. Pat. No. 2,661,798 to Clevenger et al. and Rodman et al. U.S. Pat. No. 2,537,091; which describe different steps which have been taken to protect the ignitor from the damage from fire. These steps have often resulted in a loss of reliability.

Another problem is present, particularly with flares which are used during the drilling of oil wells. In such cases, the product to be burned comes directly from the well. Because of production, often times, various liquids such as water, mud, and heavy petroleum products having low volatility and high viscosity will be emitted from the flare pipe before any gases or intermittently with the production of gases. These liquids which are either incombustible or not readily combustible will put out the flame if one is already burning at the flare pipe. In addition to this, the liquids may flow into the ignitor, filling the ignitor, thereby preventing the fuel/air mixture normally used in such an ignitor from flowing into the combustion chamber of the ignitor.

The ignitor is often supplemented by a supercharger pipe, which is a pipe that brings fuel to the flare independent of the ignitor pipe. Such a supercharger pipe is shown in U.S. Pat. No. 2,830,658 to Smith and U.S. Pat. No. 4,025,281 to Lapp.

Spark plugs are often used to ignite the fuel/air mixture within the pilot burner. This is shown in U.S. Pat. No. 2,537,091 to Rodman et al; or U.S. Pat. No. 2,460,016 to Kuhn.

Pulse generators for the spark plug are old. Instead of constantly supplying high voltage electricity to the spark plugs so that there was a continuous spark across the spark plug, it is provided a pulse source that can be adjusted for a pulse from one pulse every minute to one pulse every second. The pulse is about one second duration. This increases the reliability particularly when the pulse are sent to the plug about every 15 seconds. I.e., the electrical coils of the transformer producing the high voltage electricity are not continuously in use; and therefore, have the ability to cool and the insulation within the transformer is not to deteriorate from the excessive heat.

SUMMARY OF THE INVENTION (1) Progressive Contribution to the Art

I have discovered that by providing the electrical connection to the spark plug by ¼" diameter stainless steel rod supported from the supporting structure by a ceramic insulator, I am able to eliminate and avoid the problem of destruction of the equipment because of fire. The ceramic insulators are normally able to withstand the intense heat generated from the flame even if liquid burning oil runs upon them or the wind blows the flame directly upon them.

To prevent fluids from filling the combustion chamber, I have placed drains in the combustion chamber which are sufficiently large to allow extremely viscous thick fluids to drain from it. The fluids might be drilling muds or low volatile, high viscosity oils.

Also, I have developed a pilot burner which is not susceptible to being blown out by high winds. My burner remains burning during winds with velocities of greater than 80 miles per hour.

This particular ignitor has the gas/air mixer within an outer pipe, the outer pipe having air holes to admit air for mixing. The inlet end of the outer pipe is closed and the air holes are in the side. An inner pipe forming a combustion chamber is connected to the outlet of the fuel/air mixer and the spark plug is introduced in through the side of the inner pipe.

Thus is may be seen that the total function of my invention far exceeds the sum of the function of the individual parts such as pipes, rods, spark plugs, etc.

(2) Objects of this Invention

An object of this invention is to ignite a flare.

Further objects are to achieve the above with devices that are sturdy, compact, durable, lightweight, simple, safe, efficient, versatile, ecologically compatible, energy conserving, and reliable, yet inexpensive and easy to manufacture, install, adjust, operate and maintain.

The specific nature of the invention, as well as other objects, uses, and advantages thereof, will clearly appear from the following description and from the accompanying drawing, the different views of which are not scale drawings.

Figure 2:
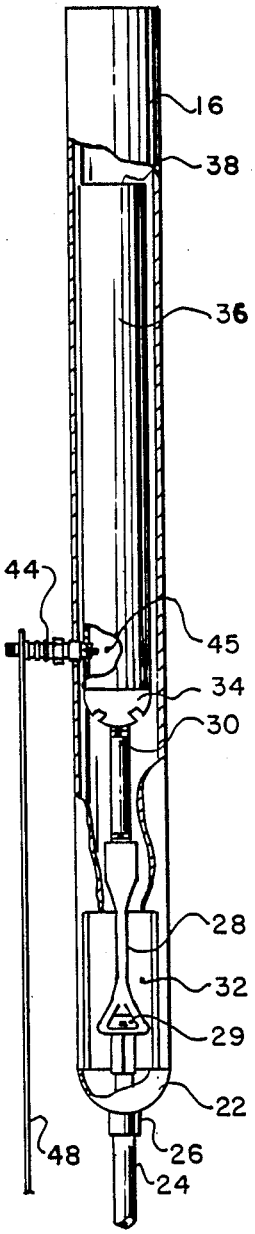
FIG. 2 is an axial, sectional view of the pilot burner.
Figure 1:
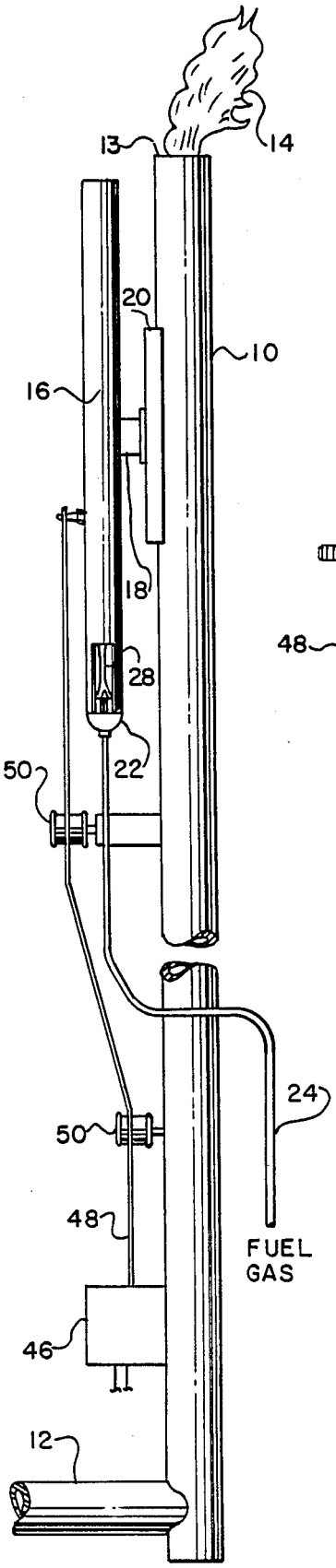
FIG. 1 is a drawing schematic in nature, showing the flare pipe with my new pilot burner attached thereto. The flare pipe has been shortened for purposes if illustration.
Figure 4:
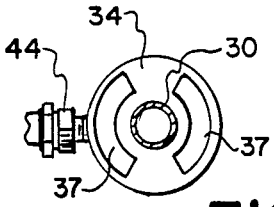
FIG. 4, is a sectional view taken on line 4—4 of FIG. 3 showing the bottom of the combustion chamber.
Figure 3:
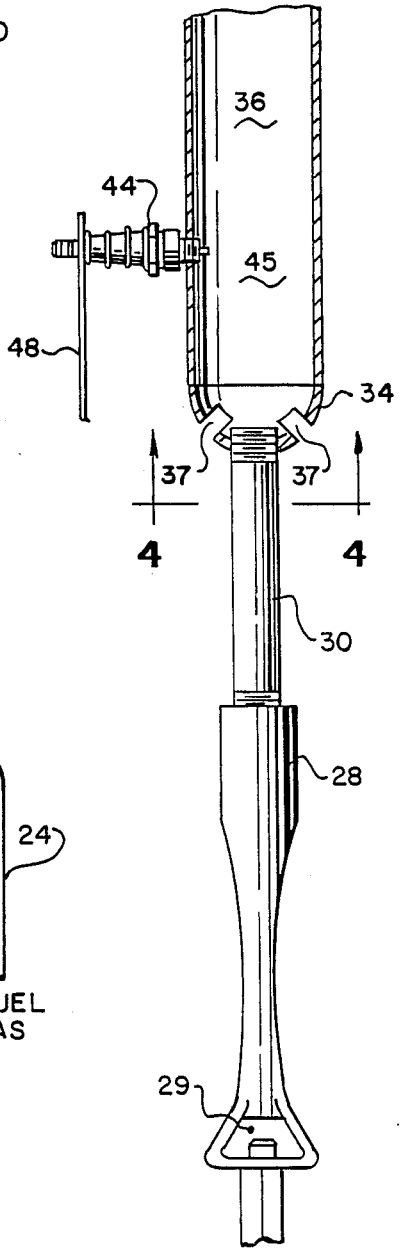
FIG. 3 is a detail of the pilot burner.

As an aid to correlating the terms of the claims to the exemplary drawing, the following catalog of elements and steps is provided:

10 flare pipe 12 connection
13 flame end, flare pipe
14 flame
16 outer pipe
18 post
20 saddle
22 cap
24 fuel or tube
26 nipple
28 mixer
29 air opening
30 spacer pipe
32 air holes
34 cap
36 inner pipe
37 holes
38 flame opening, combustion chamber
44 spark plug
45 combustion chamber
46 box
48 connector
50 insulator

DESCRIPTION OF THE PREFERRED EMBODIMENT:

Referring to the drawings, there may be seen flare pipe 10 having connection 12 whereby gas to be flared is fed to the flare pipe. At the other end or flame end 13 of the flare pipe, there is illustrated a flare or flame 14 illustrating burning of waste gas.

Outer pipe 16 of the pilot burner has a post 18 welded about its midpoint and extending radially outward from the pipe. Saddle 20 on the post is connected as by welding to the flare pipe 10 so that the outer pipe, which is tubular, and flare pipe are in a parallel side by side relationship.

One end of the outer pipe is designated as cap end and has cap 22 thereon. A gas fuel line or fuel tube 24 extends from a source of fuel gas.

Nipple 26 extends through cap 22 that is connected thereto as by welding. The outside of nipple 26 is connected to the fuel tube 24. The inside of nipple 26 is connected to air/gas mixer 28. The air/gas mixer is sometimes called a venturi inasmuch as a venturi is incorporated as a portion thereof. Such mixers are a common means for mixing gas and air. They are commonly available on the market. Although they are made of cast iron, I prefer to use stainless steel to reduce the fire hazard described above. It may be seen that the mixer 28 is within the outer pipe 16. The outer pipe 16 has large air holes 32 cut in the cap end adjacent the cap 22 on each side. Therefore the mixer will likewise be parallel to the flare pipe 10. The mixer 28 is a means for mixing gas and air in combustible proportions.

The mixer has air openings 29 therein near the air holes 32 in the outer pipe 16. The air openings form means for combustion air to enter the mixing means.

Spacer pipe 30 is attached as by threads to the outlet end of the mixer. The spacer pipe 30 is threaded upon the end downstream from the mixer 28. This end is threaded through cap 34 upon the end of inner pipe 36. The spacer pipe 30 will extend a short distance into the inner pipe as shown. The interior of the inner pipe 36 will form combustion chamber 45. Therefore, it may be seen that the combustion chamber is connected to the mixer 28 by the spacer pipe 30. The inner pipe will be within the outer pipe and coaxial therewith. The downstream end of the inner pipe 36 will terminate within the outer pipe 16. The exact location of the downstream end of the inner pipe 36 may be adjusted by changing the length of the spacer pipe 30. The downstream end of the combustion chamber 45 is called the flame opening 38, which will be at the flame end 13 of the flare pipe 10.

The cap 34 will have large slots or holes or openings 37 therein so that any liquid which might fall into the combustion chamber 45 will drain out rather than collecting within the combustion chamber with the disastrous results described above. The large holes 37 form drain means for draining mud and viscous oil from the combustion chamber.

I prefer that the outer pipe, inner pipe and most of the other parts be constructed of stainless steel.

Spark plug 44 is attached in a threaded hole in the inner pipe 36. The spark plug has the spark gap wherein the spark itself is produced within the portion ©n of the inner pipe 36 which has been designated as the combustion chamber 45. The combustion chamber is in that part of the inner pipe 36 which is adjacent to where the outlet of the mixer 28 is connected into the inner pipe 36. A hole is provided through the outer pipe 16 for the spark plug so that it may be connected and threaded into the hole in the inner pipe.

Box 46 forms a source of high voltage electricity for the spark plug 44. Electrical connector 48 extends from the source 46 to the spark plug 44. The connector is in the form of a ¼" diameter stainless steel rod. Between the source and the spark plug 44 it is supported by one or more insulators 50 so that the connector 48 is spaced away from the supporting structure. The supporting structure will be both the flare pipe 10 and the outer pipe 16. It is necessary to use a fire resistant insulator 50 to support the conductor. I refer to the fire resistant insulators as ceramic insulators, and I prefer to use aluminia porcelain to form the insulator.

I prefer to use a pulse of high voltage electricity to power the spark plug 44. Not only does this have the advantage of having less heat produced in the necessary transformer but also it has a safety factor. If a continuous high voltage is used, anyone inadvertently grasping the connector 48 will have difficulty in releasing the grasp because of muscular contractions. However if there are only pulses, to the spark plug, a person "caught" by the connector will be able to release the connector between pulses. The energy source to the box 46 which produces the high voltage electricity may either be in the form of batteries or an external source of a 110 volt alternating current electricity or from solar power. The production of a high voltage pulse of electricity from any of these sources is well within the skill of electricians and electrical engineers.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A pilot burner for a flare pipe with a flame end, comprising:

a. said pilot burner being tubular, b. saddle means on the pilot burner for connecting the pilot burner to the flare pipe in side by side relationship,
c. a fuel tube from
d. a source of fuel gas,
e. mixer means in the pilot burner connected to the fuel tube for mixing the gas and air in combustible proportions,
f. air opening on the mixer means forming means for combustion air entering the mixer means,
g. a spacer pipe connected to
h. an outlet on the mixer means,
i. an inner pipe having two ends forming a combustion chamber in the pilot burner,
j. ignition means in the combustion chamber for igniting fuel/air mixture therein,
k. a flame opening on one end of the combustion chamber at the flame end of the flare pipe,
l. a cap on the other end of the inner pipe combustion chamber,
m. said spacer pipe connected to said cap, and
n. at least one large hole in the cap forming drain means for draining mud and viscous oil from the combustion chamber.

2. The invention as defined in claim 1 further comprising:
o. a spark plug forming the ignition means,
p. a source of high voltage electricity,
q. an electrical connector from the source to the spark plug, and
r. at least one ceramic insulator supporting the connector between the plug and the source.

3. The invention as defined in claim 2 further comprising:
s. said insulator connected to the flare pipe, and
t. said electrical connector being a stainless steel rod having a diameter of about ¼".

4. A pilot burner for a flare pipe with a flame end, comprising:
a. an outer pipe,
b. saddle means on the outer pipe for connecting the outer pipe to the flare pipe in side by side relationship,
c. a fuel tube from
d. a source of fuel gas,
e. mixer means in the outer pipe connected to the fuel tube for mixing the gas and air in combustible portions,
f. large air holes in the outer pipe,
g. air openings in the mixer means near the air holes in the outer pipe forming means for combustion air entering the mixer means,
h. a spacer pipe connected to
i. an outlet on the mixer means,
j. an inner pipe having two ends forming a combustion chamber in the outer pipe,
k. a spark plug forming ignition means in the combustion chamber for igniting fuel/air mixture therein,
l. a flame opening on one end of the combustion chamber at the flame end of the flare pipe,
m. a cap on the other end of the inner pipe combustion chamber,
n. said spacer pipe connected to said cap,
o. at least one large hole in the cap forming drain means for draining mud and viscous oil from the combustion chamber,
p. a source of high voltage electricity,
q. an electrical connector in the form of a stainless steel rod having a diameter of about ¼" from the source to the spark plug, and
r. at least one ceramic insulator connected to the flare pipe, supporting the connector between the plug and the source.

* * * * *